US011703224B2

(12) United States Patent
Monfared et al.

(10) Patent No.: US 11,703,224 B2
(45) Date of Patent: Jul. 18, 2023

(54) SYSTEMS AND METHODS FOR EXTENDING THE TURNDOWN RATIO OF GAS-FIRED BURNER SYSTEMS

(71) Applicant: Rheem Manufacturing Company, Atlanta, GA (US)

(72) Inventors: Amin Monfared, Oxnard, CA (US); Danilo Aguilar, Oxnard, CA (US); Jorge Miguel Gamboa Revilla, Oxnard, CA (US); Lee Chambers, Oxnard, CA (US); Shaun Besse, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 484 days.

(21) Appl. No.: 16/851,368

(22) Filed: Apr. 17, 2020

(65) Prior Publication Data

US 2021/0325042 A1 Oct. 21, 2021

(51) Int. Cl.

| | |
|---|---|
| ***F23N 3/00*** | (2006.01) |
| ***F23L 3/00*** | (2006.01) |
| ***F23L 13/04*** | (2006.01) |
| ***F23L 1/00*** | (2006.01) |

(52) U.S. Cl.

CPC ..... *F23N 3/005* (2013.01); *F23L 1/00* (2013.01); *F23L 3/00* (2013.01); *F23L 13/04* (2013.01); *F23N 2235/06* (2020.01)

(58) Field of Classification Search

CPC ..... F23N 3/005; F23N 2235/06; F23L 1/00; F23L 3/00; F23L 13/04

See application file for complete search history.

(56) References Cited

U.S. PATENT DOCUMENTS

| | | | | |
|---|---|---|---|---|
| 2,505,845 A * | 5/1950 | Alvarez | E04H 4/0025 | 5/98.1 |
| 2,512,236 A * | 6/1950 | Molotzak | F23J 1/00 | 110/282 |
| 2,805,651 A * | 9/1957 | Weihl | F23N 5/003 | 122/390 |
| 4,498,863 A * | 2/1985 | Hanson | F23N 1/022 | 431/89 |
| 4,749,122 A * | 6/1988 | Shriver | F23N 1/022 | 236/14 |
| 4,752,211 A * | 6/1988 | Sabin | F23N 1/027 | 137/98 |
| 6,285,922 B1 * | 9/2001 | Bloss | F23D 14/60 | 700/282 |
| 6,957,798 B1 * | 10/2005 | Schmidt | F16K 7/065 | 251/6 |
| 8,627,775 B1 * | 1/2014 | Wilson | F24B 5/026 | 110/308 |

(Continued)

*Primary Examiner* — David J Laux

(74) *Attorney, Agent, or Firm* — Eversheds Sutherland (US) LLP

(57) ABSTRACT

The disclosed technology includes a device for extending the turndown ratio of a gas-fired burner system. The device can comprise a variable area device configured reduce the amount of fuel and air passed to the burner during low output conditions by adjusting the cross-sectional area of the passage between the blower and the burner. The variable area device can be controlled by an actuator that adjusts the position of the variable area device. The actuator can be manually controlled, mechanically controlled, or electronically controlled.

11 Claims, 3 Drawing Sheets

(56) References Cited

U.S. PATENT DOCUMENTS

| | | | | |
|---|---|---|---|---|
| 9,464,805 | B2 * | 10/2016 | Smelcer | F23N 3/00 |
| 2011/0212404 | A1 * | 9/2011 | Fan | F23N 5/006 431/12 |
| 2011/0223548 | A1 * | 9/2011 | Fan | F23N 1/082 431/12 |
| 2014/0076209 | A1 * | 3/2014 | Benum | F27D 19/00 110/190 |
| 2015/0017594 | A1 * | 1/2015 | Wilson | F23B 80/04 110/188 |
| 2019/0309941 | A1 * | 10/2019 | Pondo | F23C 6/045 |

* cited by examiner

SYSTEMS AND METHODS FOR EXTENDING THE TURNDOWN RATIO OF GAS-FIRED BURNER SYSTEMS

FIELD OF TECHNOLOGY

The present disclosure relates generally to systems, devices, and methods for extending the turndown ratio of a gas-fired burner.

BACKGROUND

Turndown ratio is a measurement of maximum capacity compared to minimum capacity and is often used to measure the performance of combustion plant equipment, such as boilers and gasifiers. For example, when used to describe the performance of a boiler, the turndown ratio is a measurement of the boiler's maximum output to the boiler's minimum output. Turndown ratio can be an important consideration when determining whether the boiler can meet the design requirements or constraints of a specific application. This is because the boiler must meet maximum output requirements as well as cycle down to a low output without being shut off completely. If a boiler is shut off completely, the boiler must go through a specific startup sequence, which can take several minutes and can prevent the boiler from being available for sudden load demands until the startup sequence has been completed. The boiler may also be required to complete a pre-purge and post-purge cycle during startup and shutdown, which can lead to heat loss and can negatively impact the boiler's efficiency.

To avoid the negative implications associated with shutting off a boiler, it is common to keep the boiler online, even when it's not needed. However, this can result in costly fuel consumption, especially if the boiler is incapable of operating at a low minimum output. Therefore, a boiler that can modulate down to a low output and stay online can be more efficient and/or more cost-effective than a boiler that cannot modulate down to a low output.

The lower the minimum output for a given maximum output, the higher the turndown ratio will be. Thus, boilers that can operate at a low output typically have a higher turndown ratio than other boilers because their maximum output to minimum output ratio is higher. For example, a boiler with a maximum output of 2 MM BTU/hr and a minimum output of 500 k BTU/hr will have a turndown ratio of 4:1, while a boiler with a maximum output of 2 MM BTU/hr and a minimum output of 100 k BTU/hr will have a turndown ratio of 20:1.

Because turndown ratio can be increased by lowering the minimum output of a boiler, existing methods and techniques have been employed to help modulate the boiler down to a lower minimum output. These methods generally include the use of multiple burner assemblies having additional burners, blowers, and gas valves. In this configuration, each of the individual burner assemblies can be operated independently of the other burner assemblies to respond to load demand. Although the use of multiple burner assemblies does help to extend the turndown ratio, the incorporation of additional components can make the system more complex and more costly to manufacture, and the presence of additional components can increase the cost of maintenance and/or increase the number of points of failure in the system. Thus, it is desirable for a boiler to operate at a lower minimum output, and thus extend the turndown ratio, while mitigating or eliminating the need for additional burner assemblies or other components. This and other problems are addressed by the technology disclosed herein.

BRIEF SUMMARY

The disclosed technology includes a device for extending a turndown ratio of a gas-fired burner system. The device can include a variable area device that can adjust a cross-sectional area of a passage between a blower outlet of the gas-fired burner system and a burner inlet of the gas-fired burner system and can include an actuator that can adjust a configuration of the variable area device to change the cross-sectional area of the passage.

The device can include a controller that can output instructions to the actuator to adjust the configuration of the variable area device based on received system data. The system data can include the speed of a blower, a control signal of the gas-fired burner system, or data from a flue sensor.

The actuator can be configured to mechanically adjust the configuration of the variable area device with a centrifugal governor system in response to a change in blower speed. Alternatively, the actuator can be configured to adjust by input from an operator. The actuator can be configured to adjust its position either manually or electronically. The actuator can be a valve, a damper system, a mechanical iris, multiple interchangeable pre-defined cross-sectional areas, or have an apparatus with a flexible internal structure.

The disclosed technology also includes a method for extending a turndown ratio of a gas-fired burner system. The method can include receiving system data indicative of a gas-fired burner's performance, determining to adjust a variable area device from a first configuration to a second configuration based on the system data, and transmitting instructions to an actuator to adjust the variable area device from the first configuration to the second configuration. The system data can include blower speed data, a control signal of the gas-fired burner system, or data received from a flue sensor.

The disclosed technology includes a system that includes a blower, a burner, a variable area device that can adjust a cross-sectional area of a passage fluidly connecting the blower to the burner, an actuator, and a controller. The controller can include one or more processors and memory storing instructions that, when executed by the one or more processors, direct the controller to receive output data of the gas-fired burner system and output a control signal to adjust the cross-sectional area of the variable area device in response to determining that the output data indicates that the gas-fired burner system has reduced its output.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
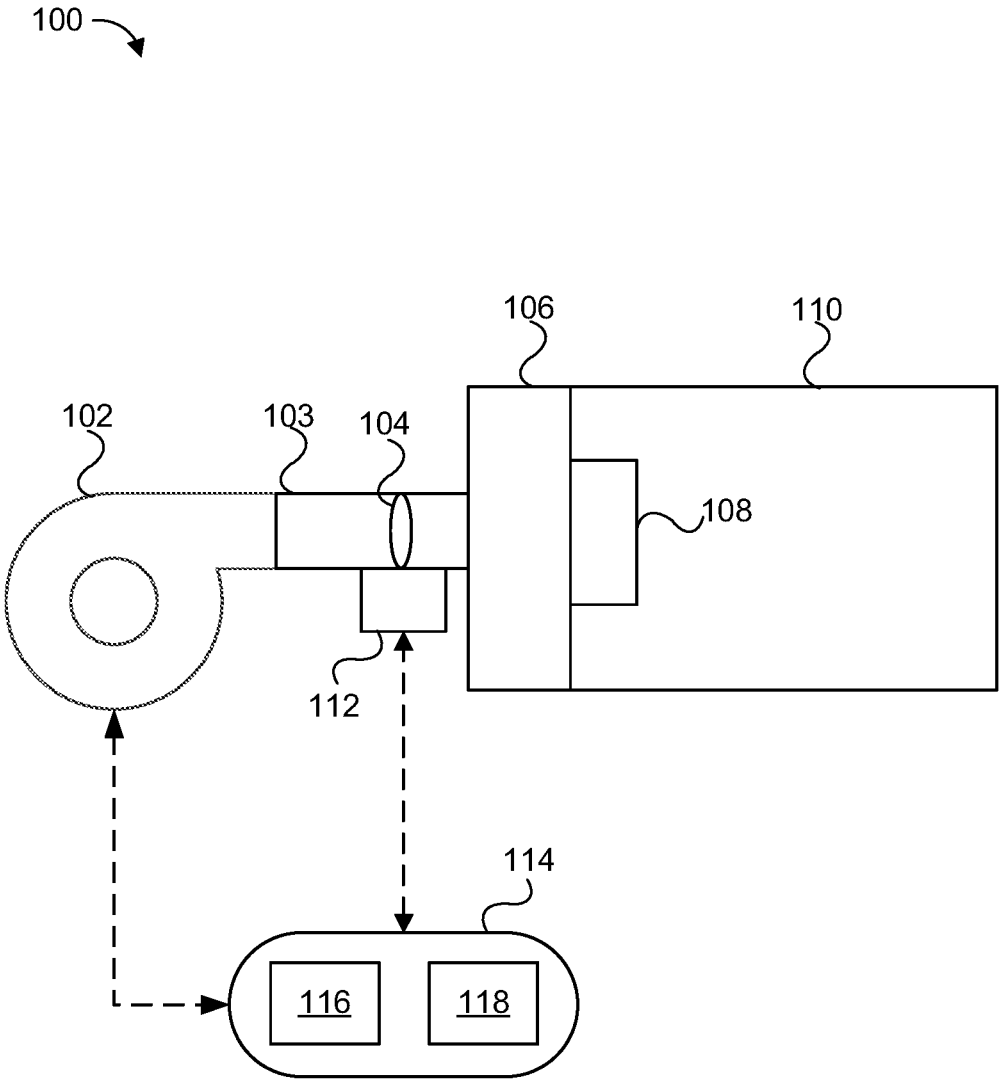
FIG. 1 is a schematic view of a system for extending the turndown ratio of a gas-fired burner system, in accordance with the presently disclosed technology.

The disclosed technology relates to systems and methods for extending the turndown ratio of a gas-fired burner system. For example, the disclosed technology can provide systems and methods for extending the turndown ratio of a gas-fired burner system without multiple burners, blowers, or gas valves. The disclosed technology can be incorporated with a gas-fired burner system that comprises a single blower, a single burner, and a single gas valve as well as systems with multiple blowers, burners, and gas valves.

Although certain examples of the disclosed technology are explained in detail, it is to be understood that other examples, embodiments, and implementations of the disclosed technology are contemplated. Accordingly, it is not intended that the disclosed technology is limited in its scope to the details of construction and arrangement of components set forth in the following description or illustrated in the drawings. The disclosed technology is capable of other embodiments and of being practiced or carried out in various ways. Also, in describing the many examples, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing the examples, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the various examples of the disclosed technology includes from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required. Further, the disclosed technology does not necessarily require all steps included in the example methods and processes described herein. That is, the disclosed technology includes methods that omit one or more steps expressly discussed with respect to the examples provided herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

To facilitate an understanding of the principles and features of the disclosed technology, various illustrative examples are explained below. In particular, the presently disclosed subject matter is described in the context of being a system for extending the turndown ratio of a gas-fired burner system. The present disclosure, however, is not so limited, and can be applicable in other contexts. For example, and not limitation, the present disclosure may improve other heating systems that do not use a gas burner. Such implementations and applications are contemplated within the scope of the present disclosure. Accordingly, when the present disclosure is described in the context of a system for extending the turndown ratio of a gas-fired burner system, it will be understood that other implementations can take the place of those referred to.

Referring now to the drawings, in which like numerals represent like elements, examples of the present disclosure are herein described.

As shown in FIG. 1, a gas-fired burner system 100 can comprise a blower 102 that is configured to provide a premixed air-fuel mixture to a combustion chamber 110 that includes a burner 108, which can be configured to ignite the air-fuel mixture. The blower 102 can thus be in fluid communication with the combustion chamber 110 and/or burner 108. The burner system 100 can include an air-fuel manifold 106 disposed between the blower 102 and the combustion chamber 110 and/or the burner 108. The burner system 100 can include a passage 103 disposed between the blower 102 and the air-fuel manifold 106, the combustion chamber 110, and/or the burner 108. The passage 103 can be a pipe, tube, conduit, hose, duct, line, or any other type of passage configured to contain a fluid. As will be appreciated, the passage 103 can refer to any linking structure or mechanism between the blower 102 and the burner 108 and/or combustion chamber 110. For example, the passage 103 can refer to an extension of the blower itself, which can be connected to the blower 108 and/or combustion chamber 110. Some or all of the blower 102, the passage 103, the air-fuel manifold 106, the burner 108, and the combustion chamber 110 can be in fluid communication, either directly or indirectly (i.e., via another component). One of skill in the art will understand that the various components of the gas-fired burner system 100 (e.g., the blower 102, the air-fuel manifold 106, the burner 108, the combustion chamber 110), can each be sized, dimensioned, positioned, and configured for various applications. The following discussion will describe additional details of various components, variations of these components, and ways in which the components can be operated together.

The gas-fired burner system 100 can include a variable area device 104 that can be located anywhere in the gas-fired burner system 100 so as to extend the turndown ratio of the system. The variable area device 104, for example, can be located downstream of the blower 102 and upstream of the burner 108. Furthermore, the variable area device 104 can be located inside the passage 103 or outside of the passage 103. The variable area device 104 can be configured to selectively adjust the cross-sectional area of a passage 103 between the blower 102 and the burner 108 (e.g., between the blower 102 and the air-fuel manifold 106). The variable area device 104 can be configured to adjust the effective inner diameter of the passage 103. By adjusting the cross-sectional area of passage 103, the variable area device 104 can affect the output of fuel-air mixture from the blower 102 to the burner 108. In turn, by affecting the air-fuel mixture delivered to the burner 108, the variable area device 104 can directly affect the output of the gas-fired burner system 100 and the resultant turndown ratio. For example, in an example gas-fired burner system 100 configured to provide a minimum output of 200 k BTU/hr, the installation of a variable area device 104 downstream of the blower 102 (e.g., in the passage 103) can reduce the minimum output to 150*k* BTU/hr or less, effectively extending the turndown ratio of the gas-fired burner system 100.

As explained above, the variable area device 104 can be located within the passage 103. Alternatively or in addition, the variable area device 104 can be located outside of the passage 103. For example, the variable area device 104 can be attached to, or located near, an outside surface of the passage 103, and the variable area device 104 can be configured to press against the outside surface of the passage 103 to reduce the internal diameter of the passage 103. Such a configuration can be particularly advantageous if the passage 103 comprises a deformable sidewall (e.g., tubing).

The variable area device 104 can be adjusted by an actuator 112, either manually or as directed by a controller 114, to restrict the flow of the air-fuel mixture from the blower 102 and reduce the amount of fuel used when the gas-fired burner system 100 is operated at low loads (e.g., at minimum output). This can be especially true in systems where the fuel is added to the system via a zero-governor gas valve. Because the zero-governor gas valve adds fuel to the system proportional to the amount of vacuum pressure exerted on the zero-governor gas valve outlet, restricting the passage 103 downstream of the blower can result in a higher back pressure and can reduce the vacuum pressure near the zero-governor gas valve. This can result in the zero-governor gas valve adding less fuel to the system because of the reduction in vacuum pressure. Thus, the variable area device 104 can reduce the fuel used by the gas-fired burner system 100 when operated at its lowest output. In systems that do not use a zero-governor gas valve, the gas valve can be physically adjusted, either manually or automatically, when the variable area device 104 restricts the passage 103 downstream of the blower 102 to reduce the turndown ratio.

The disclosed technology includes variable area devices 104 having many different designs and configurations, provided the variable area device 104 can adjust the cross-sectional area of the passage 103. For example, the variable area device 104 can be or include a valve configured to restrict the passage 103. The valve can be any appropriate form of valve, including but not limited to, a ball valve, a plug valve, a butterfly valve, a rotary valve, a linear valve, a gate valve, a globe valve, a needle valve, a solenoid valve, a coaxial valve, an angled seat valve, a pinch valve, a shutter valve, or any other valve that would be appropriate for the particular application.

Figure 2A:
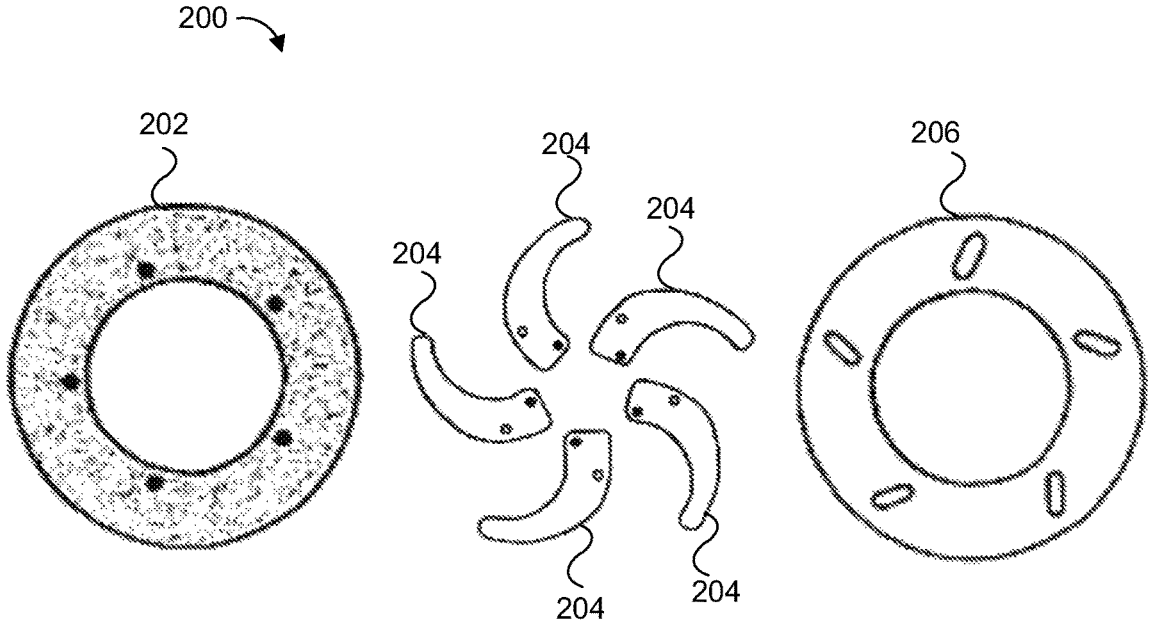
FIG. 2*a* illustrates components of a mechanical iris, in accordance with the presently disclosed technology.
Figure 2B:
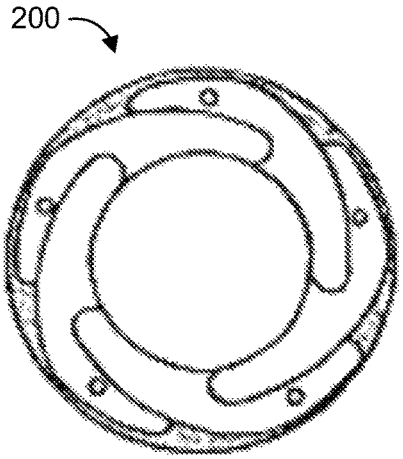
FIG. 2*b* illustrates a mechanical iris in an opened position, in accordance with the presently disclosed technology.
Figure 2C:
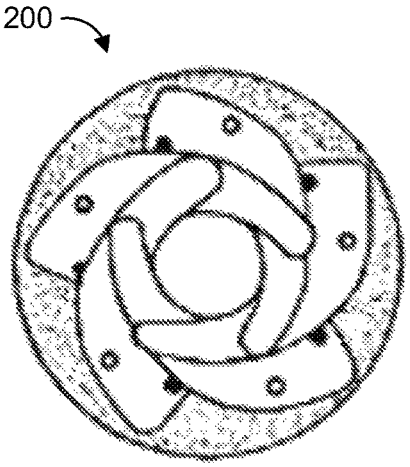
FIG. 2*c* illustrates a mechanical iris in a partially closed position, in accordance with the presently disclosed technology.

As another example, the variable area device 104 can be or include a mechanical iris 200. As shown in FIG. 2*a*, a mechanical iris 200 can include, for example, a base ring 202, a plurality of blades 204 each having a curved, tapering cross-sectional shape, and an actuating ring 206. The base ring 202 can include a hole corresponding to each blade 204, and the actuating ring 206 can include an angled slot corresponding to each blade 204. A first pin can be inserted through each hole of the base ring 202 and attached to a corresponding blade 204 such that each blade 204 can rotate relative the base ring 202, and a second pin can be inserted through each slot of the actuating ring 206 and attached to a corresponding blade 204 such that each blade 204 can slide relative to the actuating ring 206. Once assembled, each blade 204 overlaps an adjacent blade 204. Thus, as the actuating ring 206 is rotated relative the base ring 202, the blades 204 can transition between a fully retracted or open position (e.g. as shown in FIG. 2*b*) and a fully extended or closed position (FIG. 2*c* shows a mechanical iris in a partially closed position). The fully extended position can correspond to the tip of each blade 204 being at or near the center of the base ring 202 and actuating ring 206, such that the blades 204 substantially close the mechanical iris. The fully retracted position can correspond to the tip of each blade 204 being at or near the perimeter of the base ring 202 and the actuating ring 206, such that the blades 204 substantially open the mechanical iris. The position of the mechanical iris 200 can be electrically or mechanically adjusted by an actuator 112, which can rotate the actuating ring 206 to change the position of the blades 204.

The mechanical iris 200 can be configured in many different forms. For example, rather than blades 204, the mechanical iris 200 can have a flexible fabric or rubber diaphragm which twists open and closed when the actuating ring 206 rotates. As another example, the mechanical iris 200 can have blades which rotate from a position parallel to the flow path of the air-fuel mixture when fully-opened and to a position perpendicular to the flow path of the air-fuel mixture when fully-closed. One of skill in the art will understand that the mechanical iris 200 can be in many different configurations and still be able to change the cross-sectional area of the passage 103.

As another example, the variable area device 104 can be or include a damper system. The damper system can comprise one or more slats. If multiple slats are included, the slats can be parallel. The slats can be configured to rotate towards a closed or open position either simultaneously or individually. As an example, the damper system can include parallel slats that can transition towards a closed position to restrict air flow when the gas-fired burner system 100 modulates down to a lower load (e.g., minimum output).

The variable area device 104 can comprise multiple pre-defined cross-sectional areas that can be interchangeable to restrict the airflow while optimizing the flow path of the air-fuel mixture. For example, certain types of valves may cause undesirable turbulence through the passage 103. However, a variable area device 104 having a predefined area can be configured to optimize the flow path of the air-fuel mixture. For example, the variable area device 104 can include one or more orifice plates (commonly referred to as restriction plates) that can be inserted into the passage 103 when needed. Multiple orifice places can be either installed in series and removed one-by-one while leaving the other orifice plates in the system to adjust for the changing load demands, or the orifice plates areas can be swapped out entirely as needed. The variable area device 104 can include one or more actuators configured to selectively and independently insert and retract each of a plurality of orifice plates and/or pre-defined areas.

Alternatively, if the variable area device 104 comprises multiple pre-defined areas, the pre-defined areas can include multiple fluidly independent passageways through which the air-fuel mixture can be directed. For example, the variable area device 104 can comprise three alternate passages between the blower 102 and the burner 108. In this configuration, one or more valves can be configured to selectively and independently open and close each of the various passages. Thus, as the number or total cross-sectional area of open passages increases, the system can be subjected to a comparatively low back pressure and/or can add more fuel to the system. Similarly, when fewer passages are opened the system will have higher back pressure and less fuel will be added to the system.

As yet another example, the variable area device 104 can be or include an orifice with a changing internal area that can adjust to restrict the passage 103 between the blower 102 and the burner 108. In this example, the orifice can have a flexible internal structure that can be bent or stretched as it is adjusted, such as a solenoid valve with a flexible diaphragm, to restrict the flow of air and fuel through the passage 103.

In any of the above examples, the variable area device 104 can be made of or from any appropriate material for the application. For example, the variable area device 104 can be made of one or more metals, composites, polymers, ceramics, any alloy or combination thereof, or any other appropriate material capable of withstanding the environmental conditions within the passage 103 between the blower 102 and the burner 108.

Regardless of the type of variable area device 104, an actuator 112 can be configured to manipulate the variable area device 104 using one or more motive forces. For example, the actuator 112 can be configured to manipulate the variable area device 104 manually, electromechanically, mechatronically, pneumatically, hydraulically, or by any other method or means that can effectively control the position of the variable area device 104. As another example, the variable area device 104 can be mechanically actuated using the process fluid power of the burner system 100. That is, the variable area device 104 can be actuated using fluid pressure that is produced in the burner system 100 as the air-fuel mixture is passed from the blower 102 to the burner 108, as a non-limiting example. Although there are many ways that the position of the variable area device 104 can be manipulated, a few brief examples of actuators 112 are herein described. The following examples should not be construed as limiting but are offered merely for illustrative purposes.

If the variable area device 104 is to be operated manually, the actuator 112 can comprise several different configurations. For example, the actuator 112 can comprise a lever positioned so as to enable a user to adjust the lever to change the position of the variable area device 104. The lever can be attached to the variable area device 104 directly or through a pulley or gear system. Alternatively, the actuator 112 can comprise a manual wheel connected to a pulley or gear system configured to change a position of the variable area device 104. Similarly, the variable area device 104 can comprise a simple handle intended to be pushed inwardly or pulled outwardly to change a position of the variable area device 104. In each of these examples, the position of the variable area device 104 can be manually adjusted by a user.

Alternatively, the actuator 112 can be electronically controlled. For example, the actuator 112 can be or include a stepper motor paired with a linear mechanical actuator. The actuator 112 can also be or include a hydraulic or pneumatic actuator paired with an electronic control system. For example, the actuator 112 can be or include a hydraulic or pneumatic piston that is controlled by a solenoid valve and configured to selectively adjust a position of the variable area device 104. The actuator 112 can be or include a solenoid valve, a motor paired with a gear or pulley system, a piezoelectric actuator, twisted and coiled polymer actuator, or any other appropriate type of actuator configured to selectively manipulate the variable area device 104. In any of these examples, the actuator 112 can be configured to provide data to a controller 114 to indicate the actuator's 112 current position. One of skill in the art will understand that there are many different types of actuators 112 that could be used to manipulate the variable area device 104 depending on the particular application.

If the variable area device 104 has a mechanical actuator, the operator can manually actuate the variable area device 104 as needed when operating the system. Alternatively, the variable area device 104 can be automatically controlled by a mechanical system. For example, the variable area device 104 can be controlled by an actuator 112 tied to a mechanical system that is configured to adjust the position of the variable area device 104 depending on the speed of the blower. The mechanical system can comprise a centrifugal speed governor that utilizes the centrifugal force of mounted fly-weights to adjust the position of the actuator 112 and adjust the position of the variable area device 104. In this configuration, the actuator 112 can change the position of the variable area device 104 to restrict the flow path between the blower 102 and the burner 108 as the blower 102 decreases in speed and open the flow path as the blower 102 increases in speed.

Alternatively, the variable area device 104 can be controlled by a controller 114 that is in electrical communication with an electronically-controlled mechanical actuator 112 (e.g., forming a mechatronic system). The controller 114 can receive position data from the actuator 112 and/or the variable area device 104 to determine a current cross-sectional area of the variable area device 104 and/or to determine whether the actuator's 112 position (and thus the position of the variable area device 104) should be adjusted to change the configuration of the variable area device 104 (and thus transition to a different cross-sectional area of the variable area device 104). The controller 114 can be a central controller that can control the entire boiler system, or it can be a controller designated to control only the actuator 112 and the variable area device 104. For example, as a separate controller, the controller 114 can be in electrical communication with the main controller of the burner system 100, and/or at least some of the components and/or subcomponents of the burner system 100.

The controller 114 can be a computing device configured to receive data, determine actions based on the data received, and output a control signal instructing the actuator 112 to manipulate the variable area device 104. Although shown in FIG. 1 as being mounted separately from the actuator 112 and the variable area device 104, one of skill in the art will understand that the controller 114 can be installed anywhere as deemed appropriate for the particular application provided the controller 114 is in communication with the actuator 114. This can include installation in or on an enclosure containing the actuator 112 and the variable area device 104. Furthermore, the variable area device 104, the actuator 112, and the controller 114 can all be integrated into a single control device or may be individual devices in communication with each other. For example, the actuator 112 can be mechanically attached to the variable area device 104, but the controller 114 can be connected in wired or wireless communication with the actuator 112.

The controller 114 can be configured to send and receive wireless, hard-wired, or digital signals. The wireless signals can include Bluetooth™, BLE, WiFi™, ZigBee™, infrared, microwave radio, or any other type of wireless communication as may be appropriate for the particular application. The hard-wired signal can include any directly wired connection between the controller and the actuator 112. For example, the controller 114 can have a hard-wired 24-volt connection to the actuator 112 that directly energizes the actuator 112. The digital connection can include a connection such as an Ethernet or a serial connection and can utilize any appropriate communication protocol for the application such as Modbus, Foundation Fieldbus, PROFIBUS, Safety-Bus p, Ethernet/IP, or any other appropriate communication protocol for the application. Furthermore, the controller 114 can utilize a combination of both wireless, hard-wired, and digital communication signals to communicate with and control the actuator 112. One of skill in the art will appreciate that the above configurations are given merely as non-limiting examples and the actual configuration may vary depending on the application.

The controller 114 can have a memory 116 to execute instructions. The memory 116 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including application programs, executable instructions and data. One, some, or all of the processing techniques described herein can be implemented as a combination of executable instructions and data within the memory 116.

The controller 114, can also have a processor 118. The processor 118 can be one or more known processing devices, such as a microprocessor. One of ordinary skill in the art will understand that various types of processor arrangements could be implemented that provide for the capabilities disclosed herein.

The controller 114 can be configured to receive blower data from the blower 102 (e.g., rotational speed, air speed, temperature, air-fuel mixture concentration, etc.) and determine whether to instruct the actuator 112 to manipulate the position of the variable area device 104 based on the blower data. For example, when the gas-fired burner system 100 is modulated down to a lower output (e.g., minimum output), the blower 102 will slow down to accommodate the lower output demand. As the blower 102 slows down, the controller 114 can receive blower data indicating the change in blower 102 speed. The controller 114 can then determine that the variable area device 104 should be manipulated to restrict the flow between the blower 102 and the burner 108. Similarly, when the gas-fired burner system 100 is ramped up to a higher output, the blower 102 will speed up to accommodate the higher output demand. As the blower 102 speeds up, the controller 114 can receive blower data indicating the change in blower 102 speed. The controller 114 can then determine that the variable area device 104 should be manipulated to restrict the flow between the blower 102 and the burner 108 and send a control signal to the actuator 112 to adjust the position of the variable area device 104.

Alternatively, the controller 114 can be configured to receive system data indicative of the current load demand. In this configuration, the controller 114 can receive data or a signal (e.g., a control signal) indicating that the gas-fired burner system 100 should be modulated down to a lower output. The controller 114 can then determine when and/or to what extent the variable area device 104 should be manipulated to restrict the appropriate amount of flow between the blower 102 and the burner 108. The controller 114 can then output a signal to the actuator 112 to adjust the position of the variable area device 104 corresponding to the determined extent to which the variable area device 104 should be manipulated to restrict the appropriate amount of flow.

Additionally, or alternatively, the controller 114 can be configured to adjust the position of the variable area device 104 in response to data received from a flue sensor of an $O_2$ trim system. For example, the controller 114 can receive data from the flue sensor of an $O_2$ trim system, determine that the flue sensor data indicates that the position of the variable area device 104 should be adjusted, and output instructions to the actuator 112 to adjust the position of the variable area device 104. The flue sensor can be configured to detect gases and particulates like nitrogen, oxygen, carbon dioxide, carbon monoxide, water vapor, hydrogen fluoride, sulfur dioxide, nitric oxide, nitrogen dioxide, ammonia, various volatile organic compounds (VOCs), and any other flue gas or particulates which would be of interest. The flue sensor can also be configured to detect other phenomena like temperature or velocity of the combustion gases. The flue sensor can be any type of flue sensor used in an $O_2$ trim system, such as an electrochemical sensor, an infrared sensor, a thermocouple, or any other type of sensor configured to provide data associated with the 02 trim system.

Figure 3:
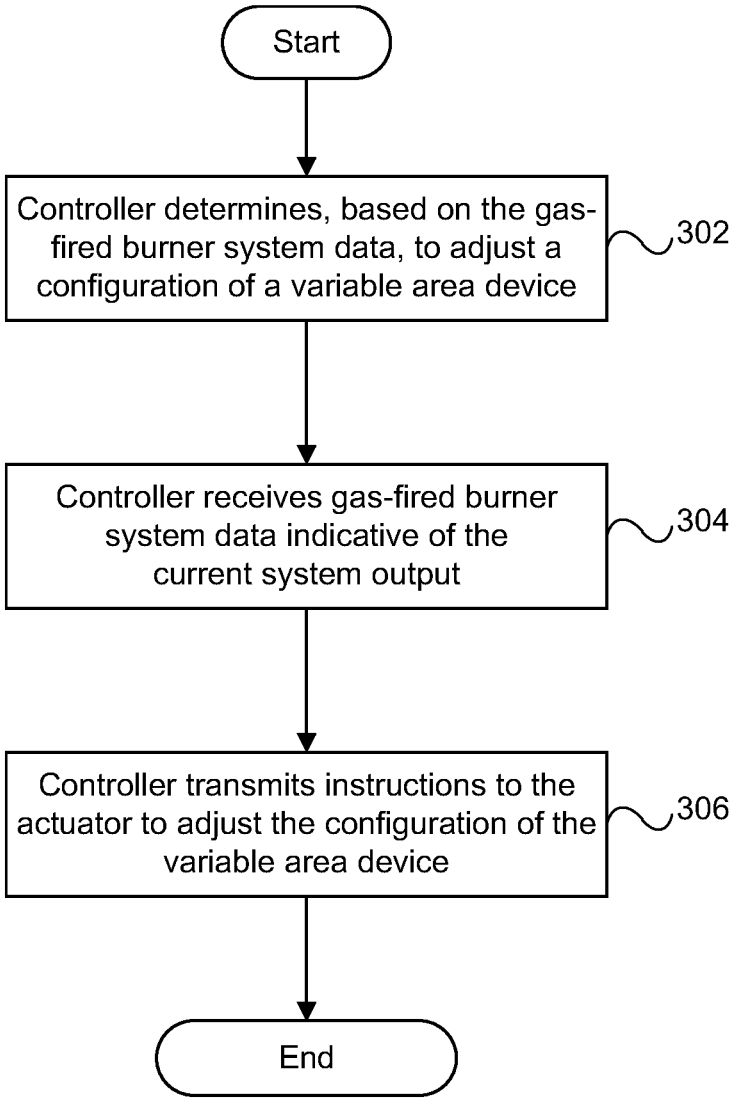
FIG. 3 is a diagram of a method of extending the turndown ratio of a gas-fired burner system, in accordance with the presently disclosed technology.

FIG. 3 is a diagram of a method of extending the turndown ratio of a gas-fired burner system, in accordance with the presently disclosed technology. FIG. 3 is not meant to limit the methods of controlling the variable area device 104 but is given merely for illustrative purposes. Furthermore, one of skill in the art will understand that the method depicted in FIG. 3 can be altered as necessary to encompass the many different configurations of the variable are device 104 as previously discussed or other configurations not discussed.

In an example shown in FIG. 3, the controller 114 can receive 302 system data of the gas-fired burner system 100 indicative of the current output of the system. The controller 114 can then determine 304, based on the received system data, whether the position of the variable area device 104 should be adjusted. If the controller 114 determines that the position of the variable area device 104 should be adjusted, the controller 114 can determine to what position the variable area device 104 should be adjusted and can transmit 306 instructions to the actuator 112 to adjust the position of the variable area device 104 to the determined position. The system data can comprise data indicative of the blower's 102 speed, data from a flue sensor in the $O_2$ trim system, a control signal from the gas-fired burner system 100, a position of a gas valve, pressure detected within the passage 103, temperature detected in the system (e.g., within the combustion chamber 108, in the boiler, at the exhaust outlet, etc.), or any other system data that can be used to determine whether the position of the variable area device 104 should be changed.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. But other equivalent methods or composition to these described aspects are also contemplated by the teachings herein. Therefore, the present disclosure should not be limited to any single aspect, but rather construed in breadth and scope in accordance with the appended claims.

What is claimed is:

1. A device for extending a turndown ratio of a gas-fired burner system, the device comprising:

a variable area device configured to adjust a cross-sectional area of a passage between a blower outlet of the gas-fired burner system and a burner inlet of the gas-fired burner system, wherein the variable area device is located outside of the passage, wherein the variable area device is a mechanical iris, which comprises a first ring and a second ring, and a flexible material that is configured to twist open or closed based on a rotation of the second ring; and an actuator, wherein the actuator is configured to rotate the second ring to adjust a configuration of the variable area device, thereby adjusting the cross-sectional area of the passage.

2. The device of claim 1 further comprising:

a controller configured to output instructions to the actuator to adjust the configuration of the variable area device based on received system data.

3. The device of claim 2, wherein the system data comprises data indicative of a speed of a blower.

4. The device of claim 2, wherein the system data comprises a control signal of the gas-fired burner system.

5. The device of claim 2, wherein the system data comprises data from a flue sensor.

6. The device of claim 1, wherein the actuator is configured to mechanically adjust the configuration of the variable area device in response to a change in blower speed.

7. The device of claim 6, wherein the actuator comprises a centrifugal governor system.

8. The device of claim 1, wherein the actuator is configured to adjust responsive to receiving input from an operator.

9. The device of claim 1, wherein the actuator is manually controllable.

10. The device of claim 1, wherein the actuator is electronically controllable.

11. The device of claim 1, wherein the flexible material comprises a flexible fabric or rubber diaphragm.

* * * * *